US010300720B2

(12) United States Patent
Boyd et al.

(10) Patent No.: US 10,300,720 B2
(45) Date of Patent: May 28, 2019

(54) CONTAINER ASSEMBLY

(71) Applicant: Hewlett-Packard Development Company, L.P., Houston, TX (US)

(72) Inventors: Patrick V Boyd, Albany, NY (US); Milo A Undlin, Corvallis, OR (US); Mike M Morrow, Salem, OR (US); Michael E Goodale, Corvallis, OR (US)

( * ) Notice: Subject to any disclaimer, the term of this patent is extended or adjusted under 35 U.S.C. 154(b) by 0 days.

(21) Appl. No.: 15/676,818

(22) Filed: Aug. 14, 2017

(65) Prior Publication Data

US 2017/0341440 A1 Nov. 30, 2017

Related U.S. Application Data

(63) Continuation of application No. 15/307,462, filed as application No. PCT/US2014/044406 on Jun. 26, 2014, now Pat. No. 9,770,927.

(51) Int. Cl.
*B41J 2/175* (2006.01)
*B41J 27/00* (2006.01)

(52) U.S. Cl.
CPC ..... *B41J 27/00* (2013.01); *B41J 2/1753* (2013.01); *B41J 2/17523* (2013.01);
(Continued)

(58) Field of Classification Search
CPC ..... B41J 27/00; B41J 2/17553; B41J 2/1753; B41J 2/17523; B41J 2/17533; B41J 2/17556
See application file for complete search history.

(56) References Cited

U.S. PATENT DOCUMENTS 6,203,146 B1 3/2001 Pawlowsksi et al.
6,464,346 B2 10/2002 Otis, Jr. et al.
(Continued)

FOREIGN PATENT DOCUMENTS

WO WO-EP 1570996 9/2005
WO WO-2012094016 7/2012
(Continued)

OTHER PUBLICATIONS

WO 2012/094012 A1, "Fluid Container Having Plurality of Chambers and Valves", Jul. 12, 2012, Paragraphs 0020-0029, Figs. 2-4 (Year: 2012).*

(Continued)

*Primary Examiner* — Lisa Solomon
(74) *Attorney, Agent, or Firm* — Rathe Lindenbaum LLP

(57) ABSTRACT

A container assembly may include a regulated tank to contain a fluid, a free tank to replenish the fluid in the regulated tank, a first expandable member between an interior of the regulated tank and ambient atmospheric pressure, a second expandable member between the interior of the regulated tank and an inflation port, a first valve to selectively connect the free tank to the regulated tank based upon a pressure differential between the interior of the regulated tank and an interior of the free tank and a second valve actuatable between an open state permitting an interior of the free tank to be pressurized and a closed state. The second valve is actuatable between the open state and the closed state based upon a position of the first expandable member.

20 Claims, 5 Drawing Sheets

(52) U.S. Cl.
CPC ..... *B41J 2/17553* (2013.01); *B41J 2/17533* (2013.01); *B41J 2/17556* (2013.01)

(56) References Cited

U.S. PATENT DOCUMENTS

| | | | |
|---|---|---|---|
| 2001/0010531 | A1 | 8/2001 | Hsieh |
| 2004/0090501 | A1 | 5/2004 | Yoshida et al. |
| 2006/0044369 | A1 | 3/2006 | Mutoh et al. |
| 2013/0335466 | A1 | 12/2013 | Olsen et al. |
| 2014/0146112 | A1 | 5/2014 | Murray |

FOREIGN PATENT DOCUMENTS

| | | |
|---|---|---|
| WO | WO-2012094018 | 7/2012 |
| WO | WO-2012094012 | 11/2013 |

OTHER PUBLICATIONS

IP.com search (Year: 2018).*

* cited by examiner

CONTAINER ASSEMBLY

CROSS-REFERENCE TO RELATED APPLICATION

The present continuation application claims priority under 35 USC § 120 from co-pending U.S. patent application Ser. No. 15/307,462 filed on Oct. 28, 2016 by Boyd et al. and entitled CONTAINER ASSEMBLY, the full disclosure of which is hereby incorporated by reference.

BACKGROUND

End users appreciate reliable components for their printing devices. They also appreciate cost-effective solutions for their printing needs. Designers and manufacturers may, therefore, endeavor to create and provide printing device components directed toward at least some of these objectives.

BRIEF DESCRIPTION OF THE DRAWINGS

The following detailed description references the drawings, wherein.

DETAILED DESCRIPTION

Printing devices deposit printing composition onto media. Printing devices may utilize printheads to deposit the printing composition onto the media. The printing composition for these printheads may be stored in and supplied by container assemblies.

A container assembly may utilize a regulator assembly for the function of controlling flow of printing composition within a body of the container assembly as the container assembly supplies printing composition to a printing device. The regulator assembly may also be utilized to accommodate changes in ambient pressure which might otherwise cause printing composition to leak from an unregulated container assembly. A container assembly may also utilize an inflation assembly for the function of priming the body of the container assembly to supply printing composition to a printing device.

The operations of the regulator assembly may be isolated from the operation of the inflation assembly. Additionally, the operations of the regulator assembly may also be isolated from each other. Providing such isolation may help to enhance the reliability of a container assembly. In some examples, this isolation should not unnecessarily increase the cost or complexity associated with the design and manufacture of a container assembly. Examples directed to achieving the foregoing are shown in FIGS. 1-7.

As used herein the term "printing device" represents a printer, plotter, press and/or device that uses any of the following marking technologies or a combination thereof: ink jet, dye sublimation, thermal transfer, 3D, laser, extrusion, off-set printing, dot matrix, or other suitable marking technologies. As used herein the terms "media" and "medium" are interchangeable and represent any type of paper or other printing medium (e.g., cloth, cardboard, canvas, transparency, substrate, powder, etc.), having any type of finish on either or both sides (e.g., glossy, matte, plain, textured, etc.), in any size, shape, color, or form (e.g., sheet, roll (cut or uncut), folded, etc.) on which printing composition (e.g., ink, toner, colorant, wax, dye, powder, latex, printing fluid or solid, etc.) is placed, jetted, deposited, dropped, ejected, formed, or laid to create text or items (e.g., text, images, graphics, pictures, formulas, charts, two-dimensional objects, three-dimensional objects, etc.). As used herein, the terms "printhead" and "printheads" represent a mechanism or device that implements any of the above-described marking technologies. A print head or print heads can be a single device or mechanism, or arranged in a module or array such as, for example, a print bar or page-wide array.

Figure 1:
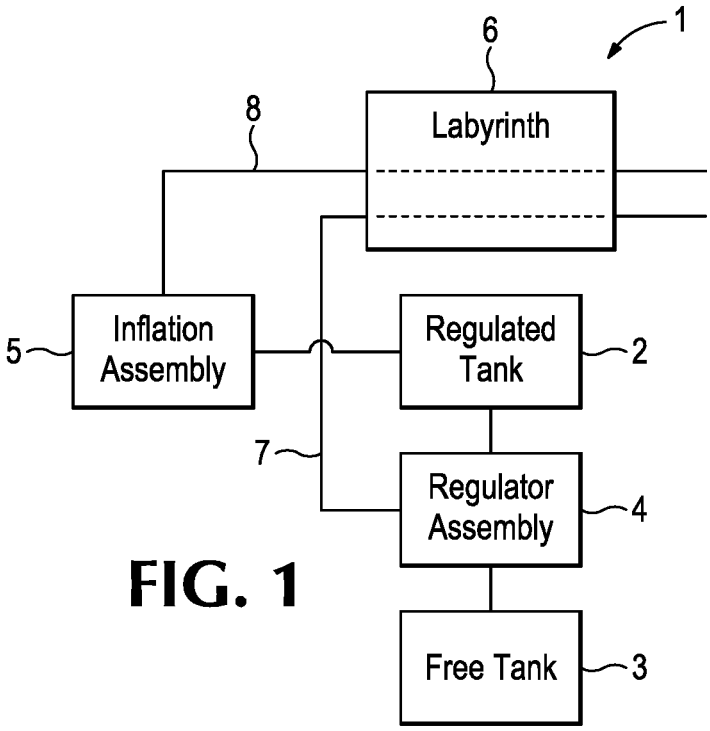
FIG. 1 is an example of a diagram of a container assembly.

An example of a diagram of a container assembly 1 is shown in FIG. 1. As can be seen in FIG. 1, container assembly 1 includes a regulated tank 2 to supply printing composition and a free tank 3 to supply reserve printing composition to regulated tank 2. Container assembly 1 also includes a regulator assembly 4 to control flow of the reserve printing composition from free tank 3 to regulated tank 2 and an inflation assembly 5 to prime regulated tank 2 to supply the printing composition. Container assembly 1 additionally includes a labyrinth 6 to fluidically isolate the flow of ambient air into and out of regulator assembly 4, as generally indicated by line 7, from the flow of a supply of air into the inflation assembly 5, as generally indicated by line 8.

Figure 2:
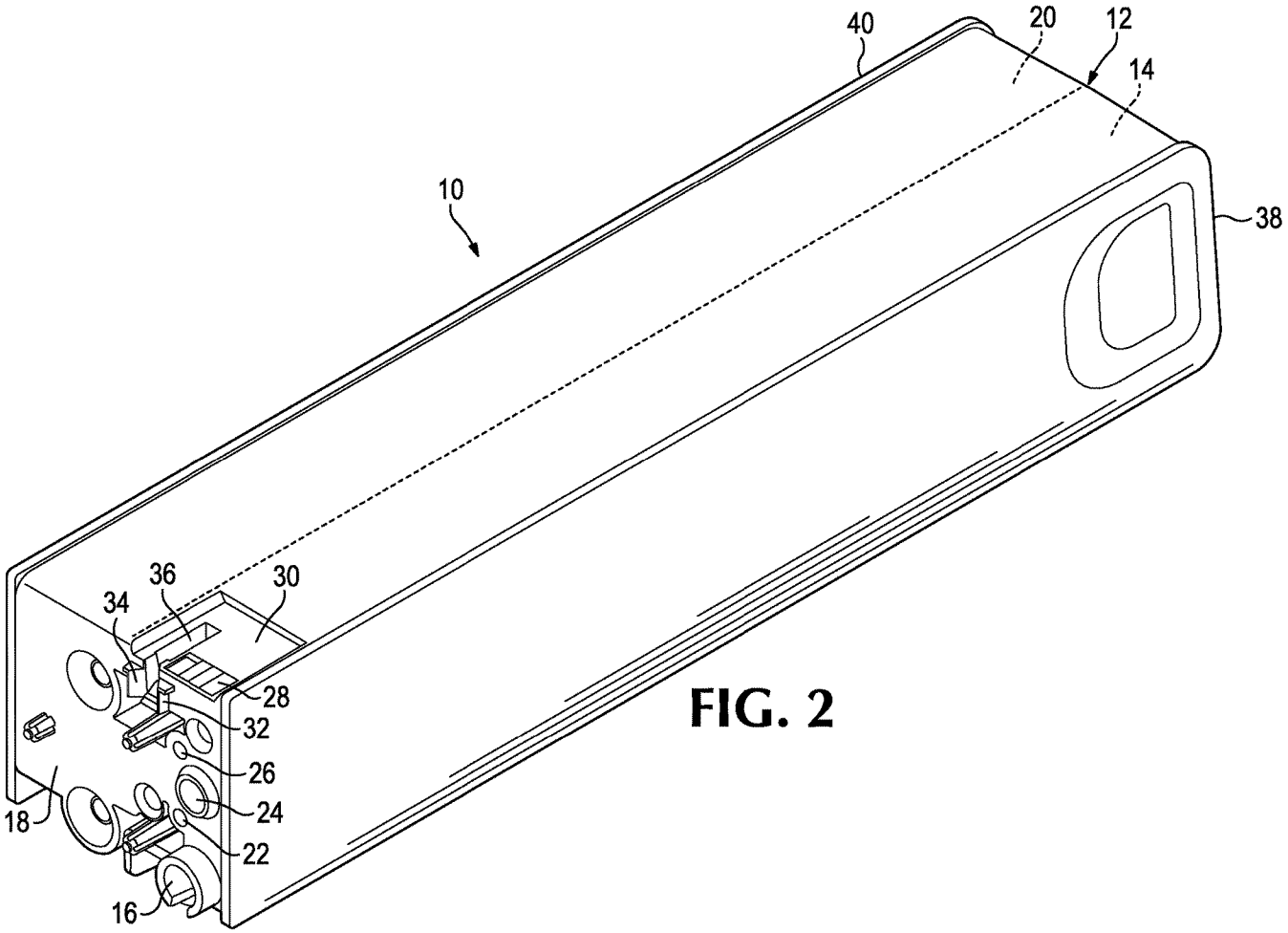
FIG. 2 is an example of a perspective view of a container assembly.

A perspective view of an example of a container assembly 10 is shown in FIG. 2. As can be seen in FIG. 2, container assembly 10 includes a body 12 to supply printing composition to a printing device (not shown). As can also be seen in FIG. 2, body 12 includes a regulated tank 14 to connect to a printing device via a printer supply port 16 on side 18 of body 12 to supply the printing composition from regulated tank 14 to the printing device. Body 12 also includes free tank 20 to store reserve printing composition that is supplied to regulated tank 12 on an as needed basis, as discussed more fully below.

As can also be seen in FIG. 2, regulated tank 14 also includes an ambient port 22 located on side 18 of body 12 to help regulate the flow of printing composition from free tank 20 to regulated tank 14. Regulated tank 14 additionally includes an inflation port 24 located on side 18 of body 12 that connects to a supply of air (not shown) to help prime regulated tank 14 of body 12 so that it supplies printing composition to a printing device. Regulated tank 14 further includes an ambient port 26 located on side 18 of body 12 that allows a regulator bag of a regulator assembly (not shown in FIG. 2) in regulated tank 14 to expand by drawing in air via ambient port 26 and collapse by forcing air out of ambient port 26. As will be discussed more fully below, the regulating assembly in conjunction with ambient port 22 helps to regulate the flow of printing composition from free tank 20 to regulated tank 14.

As can additionally be seen in FIG. 2, body 12 includes a memory 28 on a top surface 30 of body 12 that stores information that can be retrieved from memory 28 and utilized by a printing device. Information may also be written to memory 28 by a printing device. Body 12 also includes datums 32, 34, and 36 that are used to help properly position body 12 during its connection to a printing device. As can further be seen in FIG. 2, body 12 includes a pair of lids 38 and 40 that help to seal regulated tank 14 and free tank 20.

Figure 3:
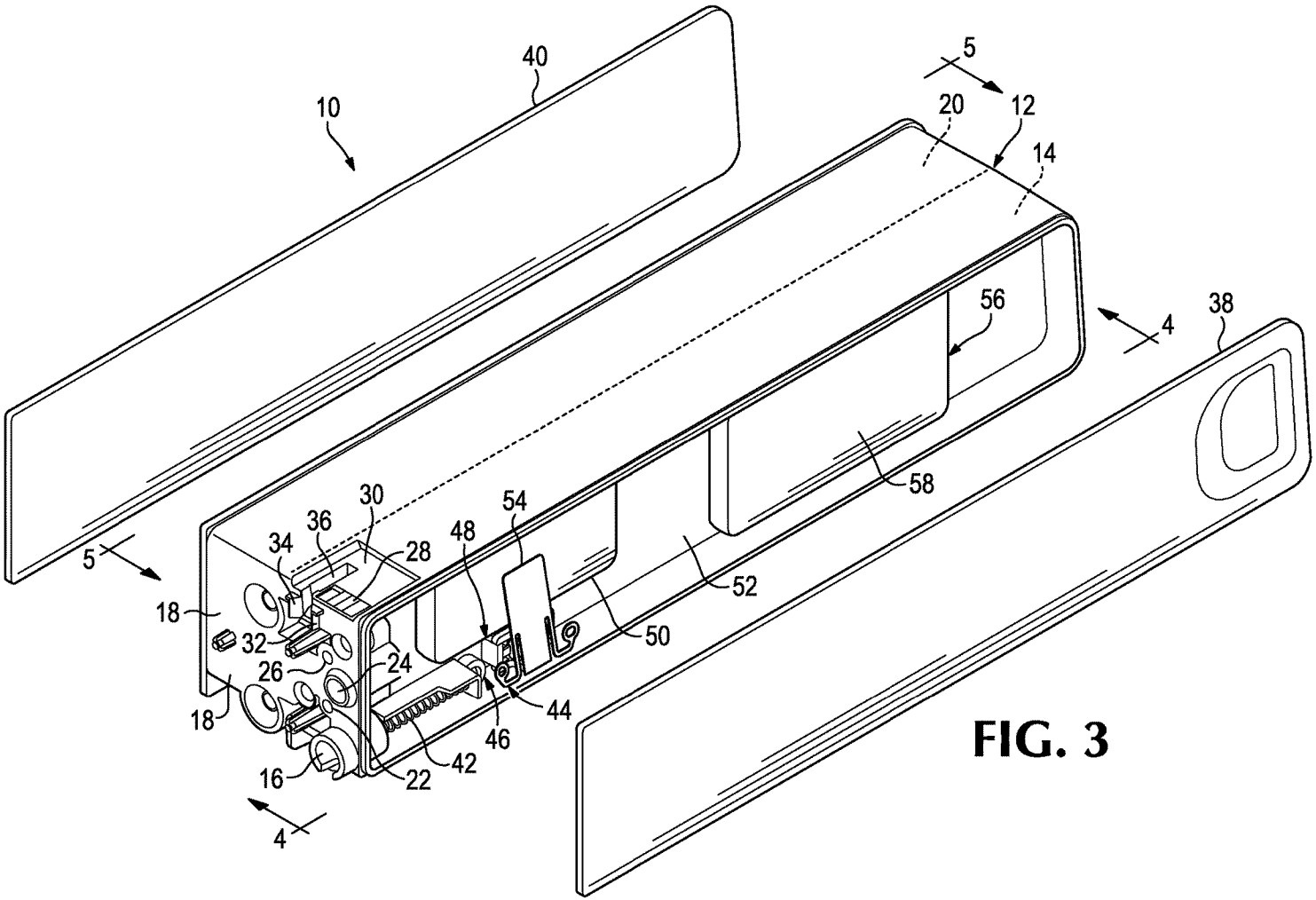
FIG. 3 is an example of a partially exploded perspective view of the container assembly of FIG. 1.

An example of a partially exploded perspective view of container assembly 10 is shown in FIG. 3. As can be seen in FIG. 3, regulated tank 14 of container assembly 10 includes a biased connector 42 adjacent printer supply port 16 to connect to a printing device (not shown). As can also be seen in FIG. 3, regulated tank 14 additionally includes a regulator assembly 44 to control flow of the supply of reserve printing composition from free tank 20 to regulated tank 14 via valve assembly 46 of container assembly 10. Regulator assembly 44 includes a regulator valve 48, a regulator bag 50 adjacent wall 52 of regulated tank 12, and a lever 54 to couple regulator valve 48 to regulator bag 50. As discussed more fully below, flow of ambient air into regulator bag 50 via ambient port 26 expands regulator bag 50 of regulator assembly 44 to actuate regulator valve 48 via lever 54 to allow ambient air to flow into free tank 20 via regulator valve 48 and ambient port 22 which displaces reserve printing composition in free tank 20 into regulated tank 14 via valve assembly 46.

As can additionally be seen in FIG. 3, regulated tank 14 of container assembly 10 also includes an inflation assembly 56 in regulated tank 14 to prime regulated tank 14 to supply printing composition to a printing device via printer supply port 16. Inflation assembly 56 includes an inflation bag 58 adjacent wall 52 of regulated tank 14. As discussed more fully below, flow of air into inflation bag 58 via inflation port 24 by, for example, an external pump (not shown), expands inflation bag 58 of inflation assembly 56 which displaces printing composition out of regulated tank 20 and into a printing device via printer supply port 16. Although not shown in FIG. 3, it is to be understood that regulator assembly 44 may include a biasing member adjacent regulator bag 50 to help collapse regulator bag 50 by displacing air from regulator bag 50 out of ambient port 26. Also, although not shown in FIG. 3, it is to be understood that inflation assembly 56 may additionally or alternatively include a biasing member adjacent inflation bag 58 to help collapse inflation bag 58 by displacing air from inflation bag 58 out of inflation port 24.

Figure 4:
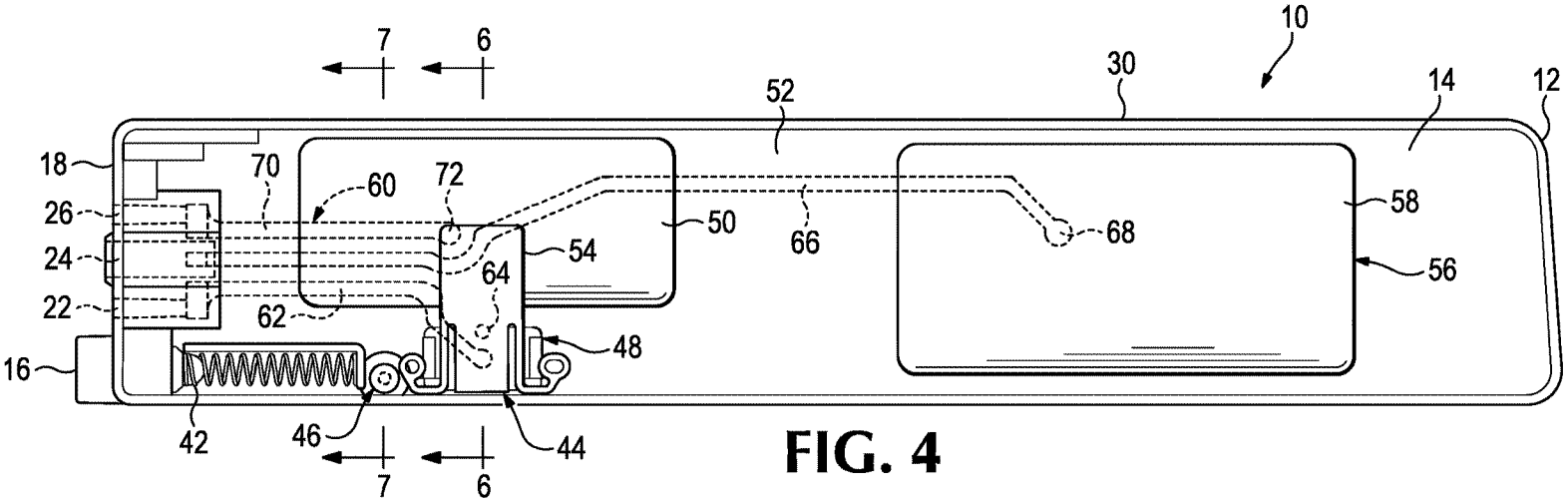
FIG. 4 is an example of a view of the container assembly of FIG. 3 along line 4-4 of FIG. 3.

An example of a view of container assembly 10 along line 4-4 of FIG. 3 is shown in FIG. 4. As can be seen in FIG. 4, container assembly 10 additionally includes a labyrinth 60 to fluidically isolate flow of ambient air into and out of regulator assembly 44 from flow of a supply of air into inflation assembly 56. Labyrinth 60 additionally fluidically isolates flow of ambient air into free tank 20 via regulator valve 48 of regulator assembly 44 from flow of ambient air into and out of regulator bag 50.

As can also be seen in FIG. 4, labyrinth 60 includes a first channel 62 between regulator assembly 44 and ambient air supplied via ambient port 22 to allow regulator assembly 44 to selectively connect the ambient air to regulator port 64 of free tank 20. Labyrinth 60 also includes a second channel 66 fluidically isolated from first channel 62 and coupled to inflation port 24 of regulated tank 12. Second channel 66 is also connected to inflation bag 58 of inflation assembly 56 via inflation assembly port 68. Labyrinth 60 also includes a third channel 70 fluidically isolated from both first channel 62 and second channel 66 to couple ambient port 26 to regulator bag 50 of regulator assembly 44 via regulator bag port 72.

Figure 5:
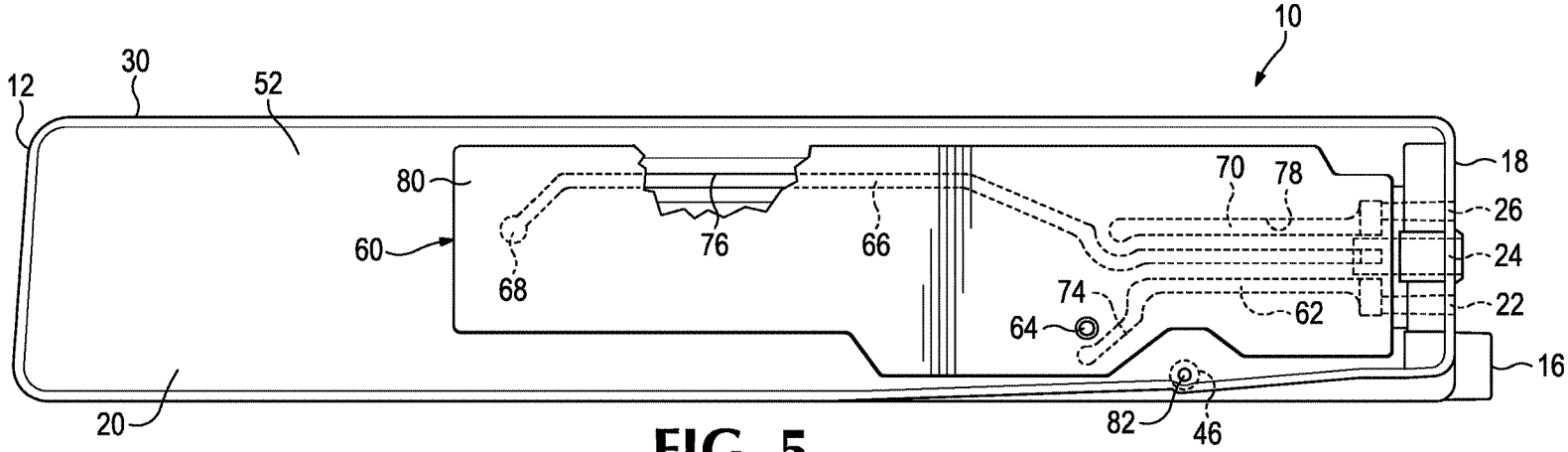
FIG. 5 is an example of a view of the container assembly of FIG. 3 along line 5-5 of FIG. 3.

An example of a view of container assembly 10 along line 5-5 of FIG. 3 is shown in FIG. 5. As can be seen in FIG. 5, first channel 62 of labyrinth 60 is defined by the combination of groove 74 in wall 52 and film 80 over groove 74 to seal groove 74. Second channel 66 of labyrinth 60 is defined by the combination of groove 76 in wall 52 and film 80 over groove 76 to seal groove 76. Third channel 70 of labyrinth 60 is defined by the combination of groove 78 in wall 52 and film 80 over groove 78 to seal groove 78. As can also be seen in FIG. 5, free tank 20 includes a printing composition supply port 82 coupled to valve assembly 46.

Figure 6B:
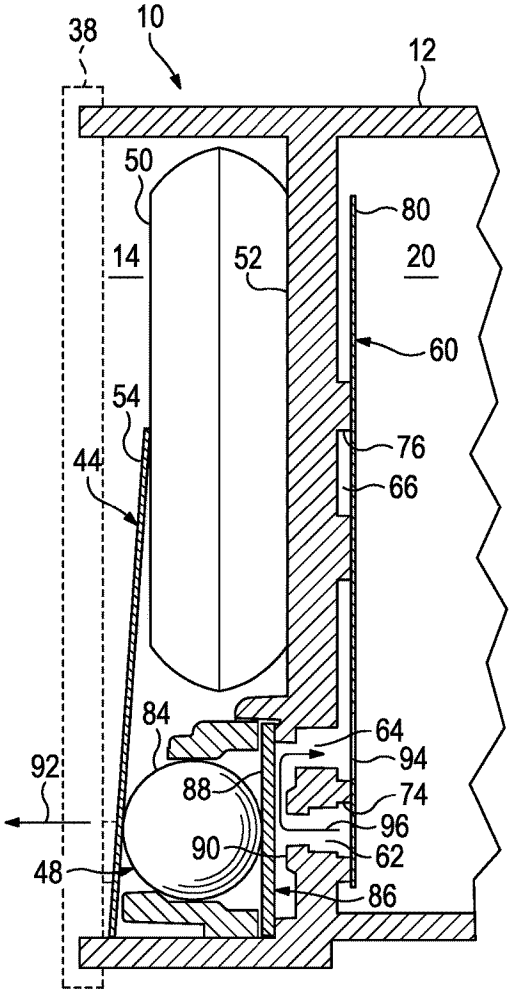
FIG. 6B is an example of another view of the container assembly of FIG. 4 taken along line 6-6 of FIG. 4.
Figure 6A:
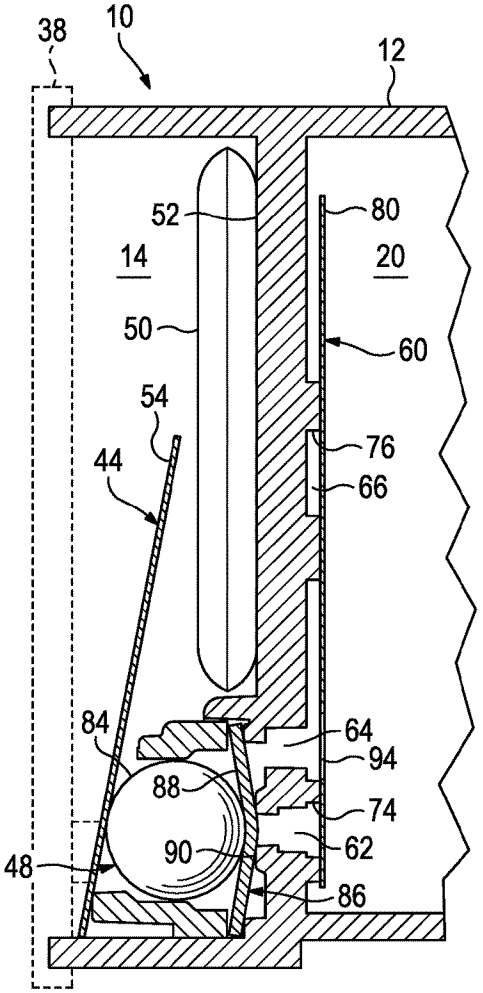
FIG. 6A is an example of a view of the container assembly of FIG. 4 taken along line 6-6 of FIG. 4.

An example of a view of container assembly 10 taken along line 6-6 of FIG. 4 is shown in FIG. 6A. As can be seen in FIG. 6A, regulator valve 48 of regulator assembly 44 includes a ball 84 coupled to lever 54 to actuate ball 84. Regulator valve 48 also includes a seal member 86 that includes a flexible disk 88 and a seat 90. Ball 84 is positioned adjacent seal member 86 to actuate seal member 86. As can also be seen in FIG. 6A, seal member 86 is actuated by ball 84 to deform flexible disk 88 which positions flexible disk 88 against seat 90 to seal regulator port 64 from first channel 62 of labyrinth 60. As can additionally be seen in FIG. 6A, regulator bag 50 of regulator assembly 44 is in a substantially deflated state.

An example of another view of container assembly 10 taken along line 6-6 of FIG. 4 is shown in FIG. 6B. As can be seen in FIG. 6B, regulator bag 50 of regulator assembly 44 is in a substantially inflated state. Regulator bag 50 inflates due to air entering regulator bag 50 via ambient port 26 (see, e.g., FIG. 4), third channel 70 (see, e.g., FIG. 4), and regulator bag port 72 (see, e.g., FIG. 4). Regulator bag 50 may inflate, as shown in FIG. 6B, because sufficient printing composition has left regulated tank 14 via printer supply port 16 (see, e.g., FIG. 4) to create a negative pressure in regulated tank 14.

As can also be seen in FIG. 6B, inflated regulator bag 50 pushes against lever 54 which actuates ball 84 of regulator valve 48 to move ball 84 in the direction of arrow 92. Movement of ball 84 of regulator valve 48 in the direction of arrow 92 allows flexible disk 88 of seal member 86 to move away from seat 90 to unseal regulator valve 48 so that regulator port 64 fluidly communicates with first channel 62 of labyrinth 60. This allows air to enter ambient port 22 (see, e.g., FIG. 4), travel through first channel 62 of labyrinth 60 to regulator port 64, and enter free tank 20 through hole 94 in film 80, as generally indicated by arrow 96. This movement of air into free tank 20 displaces reserve printing composition in free tank 20 forcing the reserve printing composition from free tank 20 into regulated tank 14 via an open valve assembly 46 (see, e.g., FIG. 4), as discussed more fully below in connection with FIG. 7.

As reserve printing composition enters regulated tank 14 from free tank 20 via valve assembly 46, the pressure in regulated tank 14 increases. This increasing pressure in regulated tank 14 causes regulator bag 50 to deflate by forcing air therein through regulator bag port 72 (see, e.g., FIG. 4) to ambient port 26 (see, e.g., FIG. 4) via third channel 70 (see, e.g., FIG. 4) of labyrinth 60. Eventually, the increased pressure in regulated tank 12 causes regulator bag 50 to deflate back to the condition shown in FIG. 6A. Deflation of regulator bag 50 allows lever 54 of regulator assembly 44 to actuate ball 84 of regulator valve 48, in a direction generally opposite of arrow 92 (see FIG. 6B), so that ball 84 forces flexible disk 88 of seal member 86 against seat 90 to seal regulator port 64 from first channel 62 of labyrinth 60.

Figure 7:
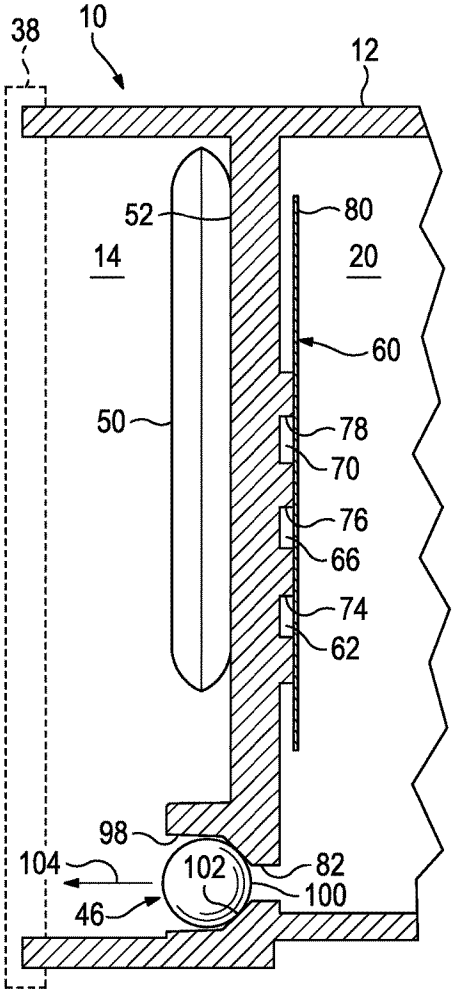
FIG. 7 is an example of a view of the container assembly of FIG. 4 taken along line 7-7 of FIG. 4.

An example of a view of container assembly 10 taken along line 7-7 of FIG. 4 is shown in FIG. 7. As can be seen in FIG. 7, regulated tank 14 of container assembly 10 includes a printing composition replenishment port 98. As can also be seen in FIG. 7, valve assembly 46 of container assembly 10 is positioned between printing composition supply port 82 and printing composition replenishment port 98. Valve assembly 46 additionally includes a ball 100 positioned against a seat 102 to close valve assembly 46, blocking the flow of reserve printing composition from printing composition supply port 82 of free tank 20 to printing composition replenishment port 98 of regulated tank 14 via valve assembly 46.

As can additionally be seen in FIG. 7, movement of ball 100 of valve assembly 46 away from seat 102 in the direction generally indicated by arrow 104, would open valve assembly 46, allowing reserve printing composition to flow from free tank 20 via printing composition supply port 82 through valve assembly 46 to regulated tank 14 via printing composition replenishment port 98. Ball 100 assumes the position shown in FIG. 7 against seat 102 to closed valve assembly 46 when the pressure in regulated tank 14 is greater than the pressure in free tank 20. Ball 100 moves in the direction generally indicated by arrow 104 away from seat 102 to open valve assembly 46 when the pressure in free tank 20 is greater than the pressure in regulated tank 14.

Although several drawings have been described and illustrated in detail, it is to be understood that the same are intended by way of illustration and example. These examples are not intended to be exhaustive or to be limited to the precise form disclosed. Modifications, additions, and variations may well be apparent. For example, regulator assembly 44 of container assembly 10 may also be utilized for the function of accommodating changes in ambient pressure which might otherwise cause printing composition to leak from printer supply port 16 if container assembly 10 is unregulated. As another example printer supply port 16, ambient port 22, inflation port 24 and/or ambient port 26 may be in a different location on container assembly 10 than as shown and described above.

Additionally, reference to an element in the singular is not intended to mean one, unless explicitly so stated, but rather means at least one. Furthermore, unless specifically stated, any method elements are not limited to the sequence or order described and illustrated. Moreover, no element or component is intended to be dedicated to the public regardless of whether the element or component is explicitly recited in the following claims.

What is claimed is:

1. A container assembly comprising:

a regulated tank to contain a fluid;

a free tank to replenish the fluid in the regulated tank;

a first expandable member between an interior of the regulated tank and ambient atmospheric pressure;

a second expandable member between the interior of the regulated tank and an inflation port for a source of pressurized fluid to selectively pressurize the interior of the regulated tank to a pressure above the ambient atmospheric pressure;

a first valve to selectively connect the free tank to the regulated tank based upon a pressure differential between the interior of the regulated tank and an interior of the free tank; and a second valve actuatable between an open state permitting an interior of the free tank to be pressurized and a closed state, the second valve actuating between the open state and the closed state based upon a position of the first expandable member.

2. The container assembly of claim 1, wherein the first expandable member comprises an inflatable bag having a bag interior connected to an ambient atmospheric pressure port.

3. The container assembly of claim 1, wherein the second expandable member comprises an inflatable bag having a bag interior connected to the inflation port.

4. The container assembly of claim 1 comprising:

a first fluid passage extending from an ambient atmospheric pressure port to a side of the first expandable member opposite to the interior of the regulated tank; and a second fluid passage extending from the inflation port to a side of the second expandable member opposite to the interior the regulated tank.

5. The container assembly of claim 4 comprising:

a wall having a groove; and a film across the groove to form one of the first fluid passage and the second fluid passage.

6. The container assembly of claim 5, wherein the wall has a second groove and wherein the film extends across the second groove to form the other of the first fluid passage and the second fluid passage.

7. The container assembly of claim 6, wherein the gall has a third groove and wherein the film extends across the third groove to form a third fluid passage extending from a port at ambient atmospheric pressure to the interior the free tank, the third fluid passage being selectively opened and closed by the second valve.

8. The container assembly of claim 4 further comprising a third fluid passage extending from a second ambient atmospheric pressure port to the interior of the free tank, the third fluid passage being selectively opened and closed by the second valve.

9. The container assembly of claim 1, wherein the second valve, in the open state, connects the interior the free tank to an ambient atmospheric pressure port.

10. The container assembly of claim 1, wherein the second valve comprises a lever, a ball coupled to the lever, and a seal member positioned adjacent the ball, and farther wherein the lever is coupled to the ball to actuate the ball to actuate the seal member.

11. The container assembly of claim 1, wherein the first valve comprises a seat and a ball positionable against the seat, and further wherein movement of the ball away from the seat allows the fluid to flow from the free tank to the regulated tank.

12. A container assembly comprising:

a regulated tank to contain a fluid;

a free tank to replenish the fluid in the regulated tank;

a first expandable member between an interior of the regulated tank and ambient atmospheric pressure;

a second expandable member between the interior of the regulated tank and an inflation port for a source of pressurized fluid to selectively pressurize the interior of the regulated tank to a pressure above the ambient atmospheric pressure;

a first valve to selectively connect the free tank to the regulated tank based upon a pressure differential between the interior of the regulated tank and an interior of the free tank;

a second valve actuatable between an open state permitting an interior of the free tank to be pressurized and a closed state, the second valve actuating between the open state and the closed state based upon a position of the first expandable member;

a first fluid passage extending from a first ambient atmospheric pressure port to a side of the first expandable member opposite to the interior of the regulated tank;

a second fluid passage isolated from the first fluid passage and extending from the inflation port to a side of the second expandable member opposite to the interior of the regulated tank; and a third fluid passage isolated from the first fluid passage and the second fluid passage, the third fluid passage extending from a second ambient atmospheric pressure port to the interior of the free tank, the third fluid passage being selectively opened and closed by the second valve.

13. The container assembly of claim 12, wherein the first expandable member comprises an inflatable bag having a bag interior connected to an ambient atmospheric pressure port.

14. The container assembly of claim 13, wherein the second expandable member comprises an inflatable bag having a bag interior connected to the inflation port.

15. The container assembly of claim 14, wherein the second valve, in the open state, connects the interior the free tank to a second ambient atmospheric pressure port.

16. The container assembly of claim 15, wherein the second valve comprises a lever, a ball coupled to the lever, and a seal member positioned adjacent the ball, and further wherein the lever is coupled to the ball to actuate the ball to actuate the seal member.

17. The container assembly of claim 16, wherein the first valve comprises a seat and a ball positionable against the seat, and further wherein movement of the ball away from the seat allows the fluid to flow from the free tank to the regulated tank.

18. The container assembly of claim 12, wherein the second valve, in the open state, connects the interior the free tank to an ambient atmospheric pressure port.

19. A container assembly comprising:

a regulated tank to contain a fluid;

a free tank to replenish the fluid in the regulated tank;

a first expandable member between an interior of the regulated tank ambient atmospheric pressure;

a second expandable member between the interior of the regulated tank and an inflation port for a source of pressurized fluid to selectively pressurize the interior of the regulated tank to a pressure above the ambient atmospheric pressure;

a first valve to selectively connect the free tank to the regulated tank based upon a pressure differential between the interior of the regulated tank and an interior of the free tank;

a second valve actuatable between an open state permitting an interior of the free tank to be pressurized and a closed state, the second valve actuating between the open state and the closed state based upon a position of the first expandable member; and a labyrinth to fluidly isolate the flow of ambient air to the first expandable member from the flow of a supply of pressurized air through the inflation port.

20. The container assembly of claim 19, wherein the labyrinth comprises:

a first fluid passage extending from a first ambient atmospheric pressure port to a side of the first expandable member opposite to the interior of the regulated tank;

a second fluid passage isolated from the first fluid passage and extending from the inflation port to a side of the second expandable member opposite to the interior of the regulated tank; and a third fluid passage isolated from the first fluid passage and the second fluid passage, the third fluid passage extending from a second ambient atmospheric pressure port to the interior of the free tank, the third fluid passage being selectively opened and closed by the second valve.

* * * * *